US011466538B2

(12) United States Patent
Veselka et al.

(10) Patent No.: US 11,466,538 B2
(45) Date of Patent: Oct. 11, 2022

(54) INFLOW CONTROL DEVICE AND METHOD FOR COMPLETING A WELLBORE

(71) Applicant: ExxonMobil Upstream Research Company, Spring, TX (US)

(72) Inventors: Andy J. Veselka, Houston, TX (US); Matthew S. Jackson, Houston, TX (US); Federico G. Gallo, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 281 days.

(21) Appl. No.: 16/597,480

(22) Filed: Oct. 9, 2019

(65) Prior Publication Data

US 2020/0208496 A1 Jul. 2, 2020

Related U.S. Application Data

(60) Provisional application No. 62/786,145, filed on Dec. 28, 2018.

(51) Int. Cl.

| | |
|---|---|
| ***E21B 34/06*** | (2006.01) |
| ***E21B 43/08*** | (2006.01) |
| ***E21B 47/11*** | (2012.01) |

(52) U.S. Cl.

CPC ..... *E21B 34/063* (2013.01); *E21B 43/086* (2013.01); *E21B 43/088* (2013.01); *E21B 47/11* (2020.05)

(58) Field of Classification Search

CPC .... E21B 34/063; E21B 43/086; E21B 43/088; E21B 43/063

USPC ..... 166/250.12, 260.12

See application file for complete search history.

(56) References Cited

U.S. PATENT DOCUMENTS

| | | | |
|---|---|---|---|
| 7,661,476 B2 | 2/2010 | Yeh et al. | |
| 7,708,068 B2 | 5/2010 | Hailey, Jr. | |
| 7,984,760 B2 * | 7/2011 | Haeberle | E21B 43/08 166/278 |

(Continued)

FOREIGN PATENT DOCUMENTS

| | | |
|---|---|---|
| WO | WO 2007/126496 A3 | 11/2007 |
| WO | WO 2015/168126 A1 | 11/2007 |
| WO | WO 2016/122544 A1 | 8/2016 |

*Primary Examiner* — William D Hutton, Jr.
*Assistant Examiner* — Ashish K Varma
(74) *Attorney, Agent, or Firm* — ExxonMobil Upstream Research Company—Law Department

(57) ABSTRACT

A chemically-activated inflow control device. The inflow control device comprises a tubular body configured to be connected in series to joints of sand screen in a wellbore. The tubular body forms a bore that receives a slotted base pipe. At the same time, the tubular body is fluidly connected with the sand screen joints, forming an annular flow path between the slotted base pipe and surrounding sand screen. Production fluids moving into the sand screen pass across a component that degrades in the presence of water. If the well begins producing water, the degradable component will dissolve, activating a sealing mechanism within the inflow control device and closing a restricted flow path. In this way, production fluids are not able to travel from the annular flow path into the bore of the slotted base pipe. A method for completing a wellbore having a chemically-activated inflow control device is also provided.

23 Claims, 12 Drawing Sheets

(56) References Cited

U.S. PATENT DOCUMENTS

| | | | | |
|---|---|---|---|---|
| 8,127,831 | B2 | 3/2012 | Haeberle et al. | |
| 9,816,361 | B2 * | 11/2017 | Yeh | E21B 43/14 |
| 10,012,032 | B2 | 7/2018 | Yeh et al. | |
| 10,107,093 | B2 | 10/2018 | Yeh et al. | |
| 10,294,750 | B2 * | 5/2019 | Aitken | E21B 43/12 |
| 2009/0301726 | A1 * | 12/2009 | Coronado | E21B 34/08<br>29/890.12 |
| 2014/0020898 | A1 * | 1/2014 | Holderman | E21B 43/12<br>166/229 |
| 2015/0027700 | A1 | 1/2015 | Riisem et al. | |

* cited by examiner

INFLOW CONTROL DEVICE AND METHOD FOR COMPLETING A WELLBORE

CROSS-REFERENCE TO RELATED APPLICATION

This application claims the benefit of U.S. Provisional Application 62/786,145 filed Dec. 28, 2018 entitled "Inflow Control Device and Method for Completing a Wellbore," the entirety of which is incorporated by reference herein.

BACKGROUND OF THE INVENTION

This section is intended to introduce various aspects of the art, which may be associated with exemplary embodiments of the present disclosure. This discussion is believed to assist in providing a framework to facilitate a better understanding of particular to aspects of the present disclosure. Accordingly, it should be understood that this section should be read in this light, and not necessarily as admissions of prior art.

Field of the Invention

The present disclosure relates to the field of well completions. More specifically, the present invention relates to the controlled in-flow of reservoir fluids in a wellbore. The disclosure further pertains to a downhole inflow control device capable of sensing the presence of an unwanted fluid, and autonomously activating in response.

Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of formations behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place and perforated.

Most production wellbores today are completed horizontally. This means that a lower portion of the wellbore has a heel and a toe, forming what is known as a "leg." In most cases, a string of production casing is placed along the leg. The production casing is then perforated and the surrounding formation is fractured, in stages.

In some instances the operator may desire to leave the leg (or bottom portion) of the wellbore open. In open-hole completions, a production casing is not extended through the producing zones and perforated; instead, the producing zones are left uncased. A so-called sand screen is positioned along the open wellbore forming a primary flow path for production fluids.

There are certain advantages to open-hole completions versus cased-hole completions in most conventional reservoirs. Open-hole completions allow formation fluids to converge to the wellbore radially over the entire 360 degrees of the well's azimuth. This has the benefit of lowering the pressure drop associated with converging radial flow and then flow friction through particle-filled perforation tunnels. The reduced pressure drop associated with an open-hole completion is usually beneficial for production in conventional reservoirs.

Additionally, the use of a sand screen, with or without gravel packs along the open hole wellbore, helps prevent formation fines from entering the wellbore and sanding out the well.

It is desirable to control the inflow of reservoir fluids into the wellbore. To do this, the well may be completed with screens and slotted base pipes that are concentrically placed along the horizontal leg. Inflow control devices and/or packers may be placed along the base pipes. The inflow control devices limit production in zones where they are installed by increasing the pressure drop across completion zones, thereby evening out the effects of heterogeneity in reservoir properties such as permeability, and pressure.

International Publ. No. WO 2007/126496; U.S. Pat. Nos. 7,708,068; 7,984,760; 8,127,831; and U.S. Patent Publ. No. 2015/0027700 disclose a variety of embodiments for using inflow control devices, including in connection with sand screens. These include the use of swellable or degradable material and the use of sliding sleeves. These inflow control devices may be actuated or manipulated from the surface to limit the flow of production fluids into a base pipe once production operations commence.

In some horizontal completions, a particular zone may begin to produce an undesirable quantity of water. This is known as a water breakthrough event. Early water breakthrough is one of the main challenges to achieving target production and maximum hydrocarbon recovery in reservoirs with water pressure support. In other instances, a particular zone may begin to produce an undesirable percentage of gas. This is known as a high GOR event.

A need exists for an inflow control device that is able to sense the presence of an unwanted fluid in production fluids, and automatically actuate a mechanical component in order to close off the production of fluids along the corresponding zone. A need further exists for a method of completing a wellbore wherein a chemically-activated inflow control device is placed along downhole production joints.

SUMMARY OF THE INVENTION

An inflow control device is first provided herein. In a first embodiment, the inflow control device is intended to operate in conjunction with sand screen joints along a wellbore. Preferably, the wellbore is completed horizontally as an open hole completion.

The inflow control device first includes a tubular body. The tubular body has a first end and a second opposing end. Each end is configured to be operatively connected to a sand screen joint. In one aspect, ends of the sand screen joints are welded, clamped or crimped to the opposing ends of the tubular body.

The tubular body of the inflow control device forms a bore between the first and second ends. The bore receives a base pipe that includes slots forming one or more production fluids openings. The base pipe is configured to be placed in fluid communication with production tubing in a wellbore, forming a primary flow path.

The inflow control device optionally includes an eccentric portion. The eccentric portion resides along and is a part of the tubular body. The eccentric portion has an open end for receiving production fluids that have passed through the filter medium of one of the sand screen joints. The eccentric portion also includes a restricted flow path. The restricted flow path is configured to receive the production fluids during production, and direct them to the production fluids openings in the base pipe.

Of interest, the inflow control device further includes a chemically degradable component. The chemically degradable component is fabricated from a material that degrades or dissolves over time in the presence of an unwanted fluid. Preferably, the unwanted fluid is water. Upon degradation over the period of time, a sealing mechanism within the eccentric portion is activated that closes off the restricted flow path. In this way, production fluids are no longer able to travel from the sand screen joint and into the bore of the slotted base pipe.

A production joint is also provided herein. The production joint is designed to reside and to operate within a wellbore. Preferably, the wellbore has been completed horizontally. Preferably, the production joint includes a sand screen placed within a surrounding open-hole portion of the wellbore.

The production joint comprises a first sand screen joint and a second sand screen joint. Each sand screen joint comprises a base pipe, and a filter medium placed circumferentially around the base pipe. An annular flow path is thus formed between the base pipes and the surrounding filter media. Beneficially, the annular flow path may also receive fluid leak-off during a gravel packing operation.

The production joint also includes an inflow control device. The inflow control device is placed intermediate the first and second sand screen joints. The inflow control device is constructed in accordance with the inflow control device described above. In accordance with the description above, the inflow control device will comprise a tubular body having an eccentric portion. A restricted flow path resides within the eccentric portion and places the annular flow path in fluid communication with production fluids as they pass through the filter media.

The eccentric portion houses a chemically degradable component. The component is fabricated from a material that degrades over time in the presence of an unwanted fluid. Preferably, the unwanted fluid is water and the chemically degradable component is fabricated from steel. Upon degradation over the period of time, a sealing mechanism is activated that closes off the restricted flow path in the inflow control device to all fluids.

The annular flow path is preferably sealed at opposing ends to ensure that production fluids flow through the restricted flow path of the inflow control device. In one aspect, a first annular ring resides proximate a second end of the second sand screen joint, sealing off the annular flow path at the second end of the second sand screen joint. Optionally, a second annular ring resides proximate a second end of the first sand screen joint, sealing off the annular flow path at the first end of the tubular body.

In one aspect, the cross-sectional area of the inflow control device is tuned to restrict the flow of production fluids into the bore of the base pipe after production operations have commenced. In addition, a thickness of the chemically degradable component is tuned to correspond with an anticipated acidity and flow rate of the water.

The sand screen joints optionally include a pair of coupling assemblies. These represent a first coupling assembly operatively connected at the first end of the base pipe, and a second coupling assembly operatively connected at the second end of the base pipe. Each coupling assembly comprises a manifold that receives gravel slurry from transport conduits across adjacent sand screen assemblies during a gravel packing operation.

A method for completing a wellbore in a subsurface formation is also provided herein. The wellbore preferably includes a lower portion completed horizontally.

The method first includes providing a first production tubular and a second production tubular. Each production tubular comprises a first end and a second opposing end. In one aspect, each production tubular is a blank pipe. In another aspect, each production tubular is a sand screen assembly representing a sand screen joint with a corresponding base pipe.

Where sand screen assemblies are used, each sand screen assembly may optionally comprise a coupling assembly at each end to assist in threadedly connecting adjacent joints while allowing bypass of a gravel pack slurry during a gravel packing operation. Such coupling assemblies are described in U.S. Pat. No. 10,107,093, which is incorporated herein by reference.

In any aspect, the method also includes providing an inflow control device. The inflow control device is constructed in accordance with the inflow control device described above in its various embodiments. In this respect, the inflow control device comprises a chemically degradable component. The component is fabricated from a material that degrades over time in the presence of an unwanted fluid. Degradation of the component over the period of time activates a sealing mechanism that closes off the flow path into a slotted base pipe.

The method additionally comprises operatively connecting the first end of the tubular body of the inflow control device with an end of the first sand screen joint. The method will further comprise operatively connecting the second end of the tubular body of the inflow control device with an end of the second screen joint.

The method also includes running the second sand screen joint, the inflow control device and the first sand screen joint into a wellbore. Preferably, running the second sand screen joint, the inflow control device and the first sand screen joint into a wellbore comprises placing the second sand screen joint, the inflow control device and the first sand screen joint into a horizontal leg of the wellbore.

In one aspect, the tubular body of the inflow control device seals off a first end of the sand screen joint while an annular ring resides proximate a second end of the second sand screen joint. This seals off the annular flow path at opposing ends, ensuring that production fluids that pass through the filter medium of one of the sand screen joints pass through the inflow control device. Alternatively, swell packers may be placed at opposing ends of annular flow path to isolate flow.

Preferably, the method also includes selecting a material that degrades in the presence of water for the chemically degradable material. Optionally, the method additionally comprises producing hydrocarbon fluids in commercially viable quantities from the wellbore. Producing hydrocarbon fluids causes hydrocarbon fluids to travel from the annular flow path, through the inflow control device, into the base pipe, and up to the surface.

In one embodiment of the method, the chemically degradable component comprises one or more spherical objects. Each spherical object is held in place along respective production fluid openings in the slotted base pipe. Further, each spherical object is part of a ball-valve. The valve is configured such that the spherical object permits production fluids to flow into the bore of the base pipe during production but does not permit the reverse flow of fluids down the bore of the base pipe and through the production fluid through-openings.

In this arrangement, the method further comprises: determining that water has dissolved one or more of the one or more spherical objects; and pumping a treating fluid down the bore of the base pipe and through the production fluid through-openings where the one or more spherical objects have dissolved.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
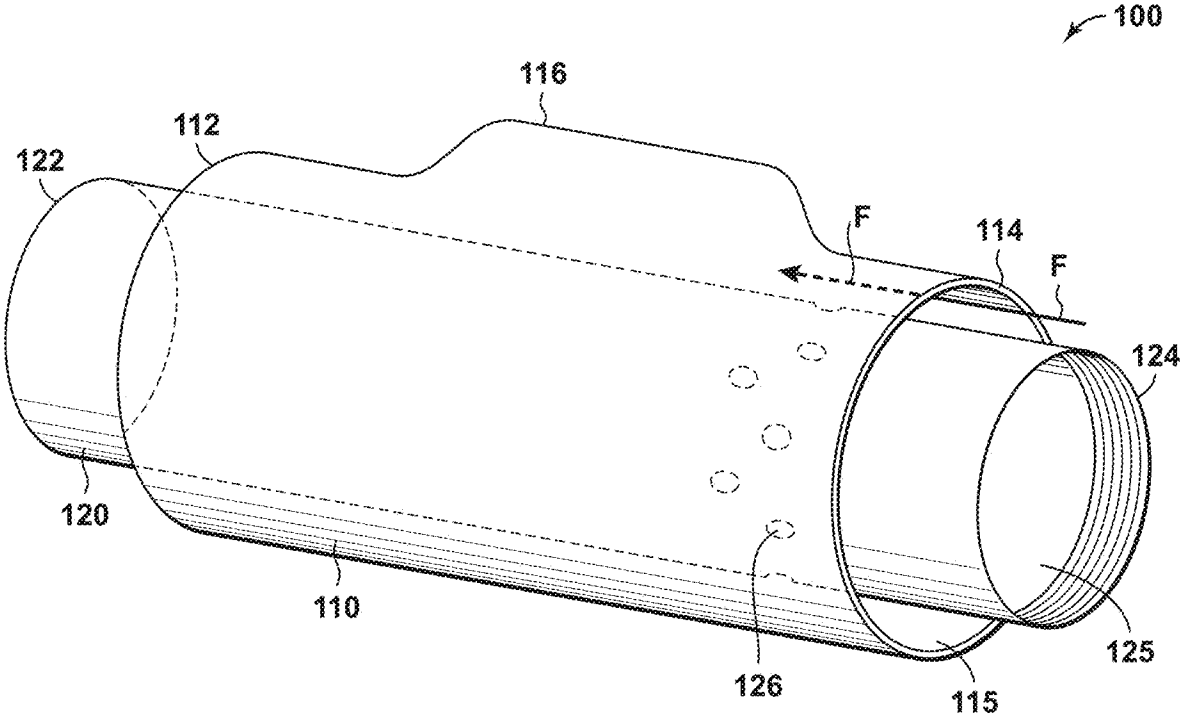
FIG. 1 is a perspective view of a chemically-activated inflow control device of the present invention, in one embodiment.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. to 20° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "production fluids" refers to those fluids, including hydrocarbon fluids, which may be received from a subsurface formation into a wellbore.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof. A subsurface interval may have more than one zone of interest.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

DESCRIPTION OF SPECIFIC EMBODIMENTS

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined and or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

FIG. 1 is a perspective view of a chemically-activated inflow control device 100 of the present invention, in one embodiment. The inflow control device 100 is designed to be placed within a wellbore (not shown). The wellbore is formed for the purpose of producing hydrocarbon fluids for processing or commercial sale. Preferably, the wellbore is completed to have an open-hole portion at a lower end of the wellbore. Preferably, the open-hole portion is formed within the subsurface of the earth in a horizontal orientation. It is observed that the majority of wells now being drilled in North America are completed horizontally.

The inflow control device 100 is used to control the flow of fluid into a downhole tubular body. An example of such a body is a slotted base pipe. Preferably, the inflow control device 100 is placed in series between opposing joints of sand screen.

The inflow control device 100 first comprises a tubular body 110. The tubular body 110 has a first end 112 and a second opposing end 114. In one aspect, each end 112, 114 comprises an outer diameter that is dimensioned to be connected to respective ends of a filter media. Connection may be by means of clamping, crimping or welding.

The inflow control device 100 comprises a bore 115. The bore 115 extends from the first end 112 to the second end 114. The bore 115 is dimensioned to receive a base pipe 120. The base pipe 120 includes a plurality of slots 126 (or other through opening configuration) for receiving hydrocarbon fluids from the subsurface formation. The base pipe 120 has its own bore 125. The bore 125 of the base pipe 120 forms a primary flow path for carrying the hydrocarbon fluids to a string of production tubing (not shown) and to the surface.

The slotted base pipe 120 extends from the opposing sand screen joints. (Illustrative sand screen joints are shown in part in FIGS. 2A and 2B.) An annular flow path is provided between the slotted base pipe 120 and the surrounding sand screen joints. The flow path extends into an internal volume of the inflow control device 100. The flow path is indicated by Arrow "F."

The slotted base pipe 120 preferably includes threads at opposing ends. The threads enable a threaded connection between base pipes of the opposing sand screen joints. This is demonstrated more fully in FIGS. 2A and 2B, discussed below.

In the illustrative arrangement of FIG. 1, the inflow control device 100 also includes an enlarged portion 116. The enlarged portion 116 is configured and dimensioned to receive internal hardware, including an orifice 250 forming a restricted flow path F'. The orifice 250 and the restricted flow path F' are also shown and described below in connection with FIGS. 2A and 2B. Of interest, the internal hardware includes a chemically-activated plunger 245 designed to close the restricted flow path F' in response to exposure to water-based fluid.

It is noted that early water breakthrough is a challenge to achieving target production and maximum hydrocarbon recovery in reservoirs with water pressure support. In some cases, water breakthrough occurs in water drive reservoirs where the oil/water interface rises. In other cases, water breakthrough occurs in water flooding operations where water sweeps into a particular zone. In any instance, an inflow control device that automatically shuts off production within a selected sand screen assembly or other downhole tool when breakthrough occurs is desired.

Figure 2A:
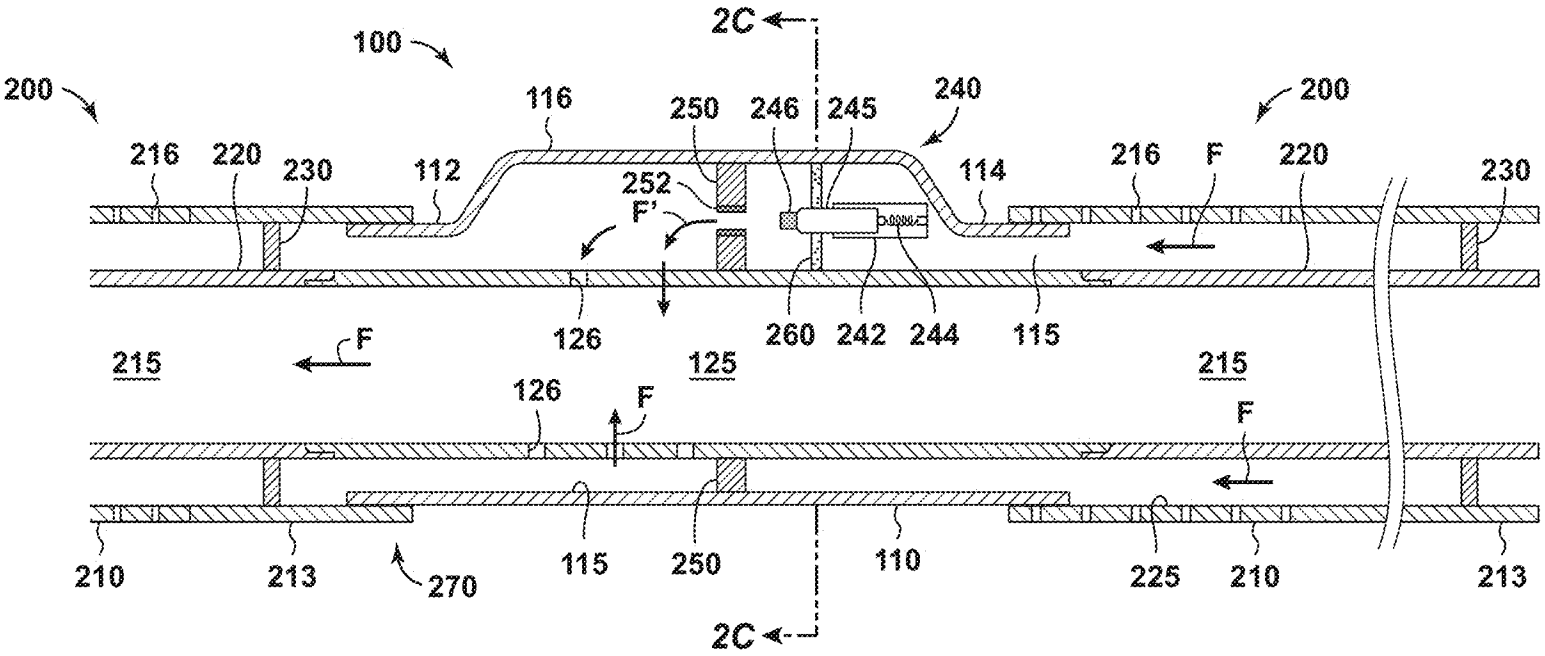
FIG. 2A is a cross-sectional view of the inflow control device of FIG. 1. The inflow control device has been placed in series between two sand screen joints. The inflow control device is in its flow position.

Referring now to FIG. 2A, a cross-sectional view of the inflow control device 100 of FIG. 1 is shown. The body 110 of the inflow control device 100 is visible along with the enlarged portion 116. Because of its shape, the enlarged portion may alternatively be referred to as an eccentric portion. Each of the opposing ends 112, 114 of the body 110 is sealingly connected to a sand screen joint 210. Sealed connections are indicated at 270.

Each sand screen joint 210 is part of a sand screen assembly 200 that includes a base pipe 220. The base pipes 220 are preferably slotted; however, one or both of the base pipes 220 may be blank pipe as may be used as part of a flow control system. An example of such a flow control system is disclosed in U.S. Pat. No. 9,816,361 issued to ExxonMobil Upstream Research Company.

The base pipes 220 comprise tubular bodies forming a bore 215. The bore 215 is part of a primary flow path for fluids being transported up to the surface. The bore 215, of course, is in series with bore 125 of slotted base pipe 120.

The sand screen joints 210 comprise a plurality of openings 216. The openings 216 are sized to permit hydrocarbon fluids to enter the annular flow path 115 while filtering out sand grains and fines. Various Arrows "F" are again provided to show the flow path of fluids passing through the sand screen joints 210 and entering the bore of the slotted base pipe 120.

It is observed that the annular flow paths 115 are sealed at opposing ends. Sealing is provided by annular rings 230. The rings 230 urge the produced fluids to move through slots 126 placed in the base pipe 120. Sealing is assisted by blank end portion 213 along the first of the sand screen joints 210.

In order for production fluids to enter the slots 126 and the primary flow path 215, the fluids must pass through a restricted flow path. Fluid flow through the restricted flow path is indicated at Arrow "F'". The restricted flow path F' is formed by an inflow control orifice 250 residing within the eccentric portion 116. The inflow control orifice 250 is preferably fabricated from steel or a durable polymer that is able to withstand the heat, pressure and corrosive nature of fluids downhole.

A cross-sectional area of the restricted flow path F' is sized by the operator in accordance with desired pressure and fluid flow control along the wellbore. The cross-sectional area is selected to create additional pressure drop along a production string (preferably in a horizontal wellbore) in order to balance production flux.

A sealing mechanism 240 is provided within the eccentric portion 116 of the inflow control device 100. When activated, the sealing mechanism 240 seals off the restricted flow path F', preventing production fluids from passing through the slots 126 and entering the primary flow path 125/215.

In the present disclosure, the sealing mechanism 240 is chemically activated. In one embodiment, the sealing mechanism 240 is specifically activated upon exposure to an aqueous fluid. To enable this, a chemically-degradable component 260 is provided along the eccentric portion 116. The chemically-degradable component 260 retains its shape when exposed to hydrocarbon fluids at downhole temperatures and pressures. At the same time, the chemically-degradable component 260 is fabricated from a material that degrades in the presence of water or acidic fluid. In one aspect, the chemically-degradable component 260 is fabricated from a carbon-based or magnesium-based steel.

It is recognized that automatic inflow control devices (or "AICD's") for pipe bodies are generally known. AICD's can deliver a variable flow restriction in response to properties of the fluid flowing through it. An example of an autonomous inflow control valve is Halliburton's EquiFlow® autonomous inflow control device. The EquiFlow® AICD can cease flow restriction if unwanted fluid in-flow recedes. The EquiFlow® AICD is responsive to fluid properties such as viscosity and density. However, such an AICD is not effective in the presence of light oil, which interestingly has about the same viscosity as water. In this instance, the EquiFlow® AICD will shut off even though the well is trying to produce hydrocarbon fluids.

In contrast, the component 260 is chemically responsive to the properties of water, allowing a shut-off of the flow of water into a pipe body upon degradation. At the same time, the component 260 does not degrade in the presence of light oil such as propane.

Referring again to FIG. 2A, the sealing mechanism 240 also includes a plunger 245. The plunger 245 resides within an elongated housing 242. The housing 242 closely and slidably receives the plunger 245. The plunger 245 is biased to move out of the housing 242 by a spring 244.

The spring 244 is held in compression by a downward force of the plunger 245. In turn, the plunger 245 is held in place along the housing 242 by the chemically-degradable component 260. So long as the formation is producing hydrocarbon fluids (at a low WOR), the component 260 will hold the plunger 245 in place. However, when the formation begins producing acidic fluids (or production fluids at a high WOR), the component 260 will begin degrading/dissolving. Eventually, the component 260 can no longer hold the plunger 245, and releases the plunger 245, allowing the spring 244 to thrust the plunger 245 forward into the inflow control orifice 250.

The tip and shoulder 246 of the plunger 245 land along an inner diameter 252 of the restricted flow orifice 250. The inner diameter 252 is preferably fabricated from an elastomeric material. Similarly, the upper tip and shoulder 246 of the plunger 245 may be fabricated from an elastomeric material. This allows the plunger 245 to sealingly land within the inflow control orifice 250.

In FIG. 2A, the inflow control device 100 is in its flow position. This means that the plunger 245 remains seated within the housing 242.

Figure 2B:
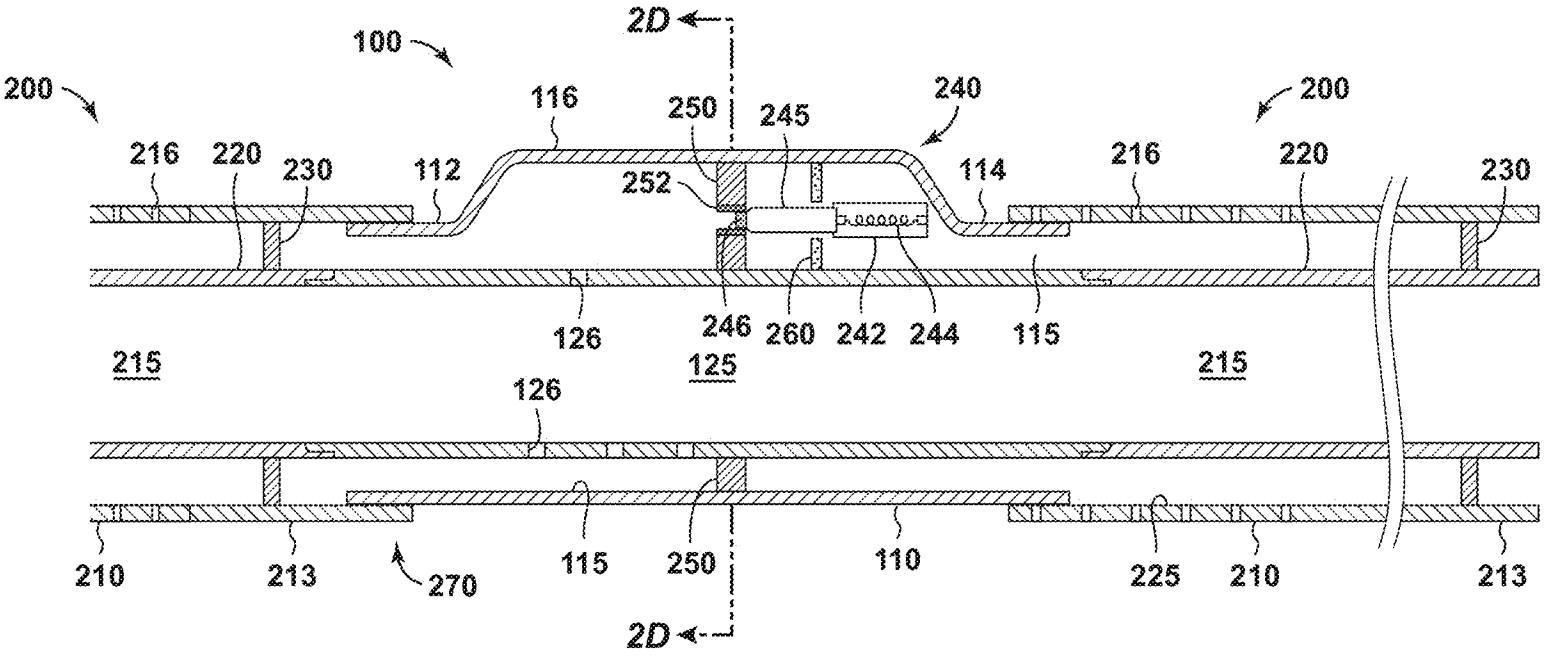
FIG. 2B is another cross-sectional view of the inflow control device of FIG. 1. Here, the inflow control device has been activated, and has moved to its sealed position.

FIG. 2B is another cross-sectional view of the inflow control device 100 of FIG. 1. Here, the inflow control device 100 has been activated. It can be seen that the plunger 245 has moved from the housing 242 and into a sealed position. The tip and shoulder 246 of the plunger 245 have landed along the inner diameter 252 of the inflow control orifice 250. When this occurs, production fluids are no longer able to flow through the restricted flow path F' and into the bore 125 of the base pipe 220.

Figure 2C:
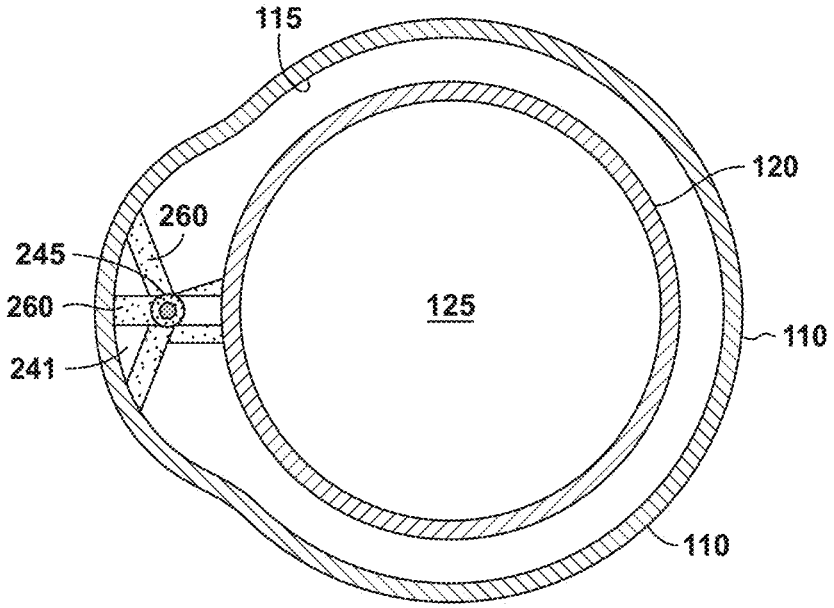
FIG. 2C is a cross-sectional view of the inflow control device of FIG. 2A. The section is taken across line 2C-2C of FIG. 2A, and shows features of the chemically-degradable component, with the plunger in its flow position.

FIG. 2C is a cross-sectional view of the inflow control device 100 of FIG. 2A. The sectional cut is taken across line 2C-2C of FIG. 2A. Here, the profile of the body 110 and the eccentric portion 116 of the inflow control device 100 can be seen, with the plunger 245 in its flow position.

Of interest, the chemically-degradable component 260 can be seen within the eccentric portion 116. In this illustrative arrangement, a somewhat starfish shape is provided for the component 260. This arrangement allows for openings 241 that permit a fuller flow of fluid F en route to the bore 125 of the slotted base pipe 120. However, it is also acceptable to have a solid piece as the component 260 as the fluid flow F may still take advantage of the full annular flow path 115.

Figure 2D:
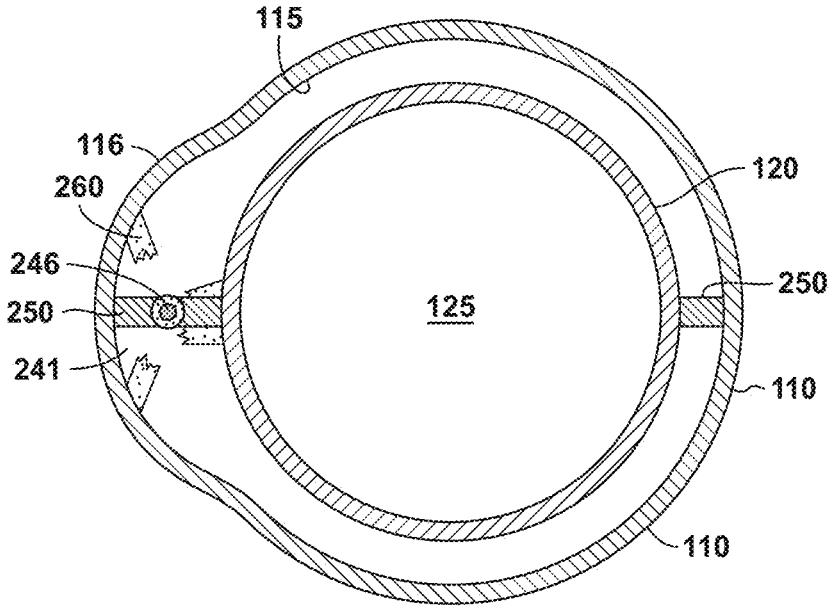
FIG. 2D is a cross-sectional view of the inflow control device of FIG. 2B. The sectional cut is taken across line 2D-2D of FIG. 2B. The profile of the body and the eccentric portion of the inflow control device are again seen, with the plunger in its sealed position.

FIG. 2D is a cross-sectional view of the inflow control device 100 of FIG. 2B. The sectional cut is taken across line 2D-2D of FIG. 2B. The profile of the body 110 and the eccentric portion 116 of the inflow control device 100 are again seen, with the plunger 245 in its sealed position. It can be seen that portions of the chemically-degradable component 260 have dissolved, allowing the release of the plunger 245 into the inner diameter 252 of the orifice 250.

In one aspect, as the chemically-degradable component 260 dissolves, a chemical tracer is released. The chemical tracer may be located with an interior portion of the component 260. The operator may periodically monitor the composition of production fluids at the surface. Once the chemical tracer is detected, the operator will know that a subsurface zone has "watered out" and that the sealing mechanism 240 has been activated.

In another aspect, the sealing mechanism 240 comprises a piezoelectric material or a small downhole battery that provides electrical energy. When the tip 246 of the plunger lands along the inner surface 252 restricted flow orifice 250, a circuit is completed and an electrical signal is sent to the surface. When the signal is detected, the operator will again know that a subsurface zone has "watered out" and that the sealing mechanism 240 has been activated.

Figure 3:
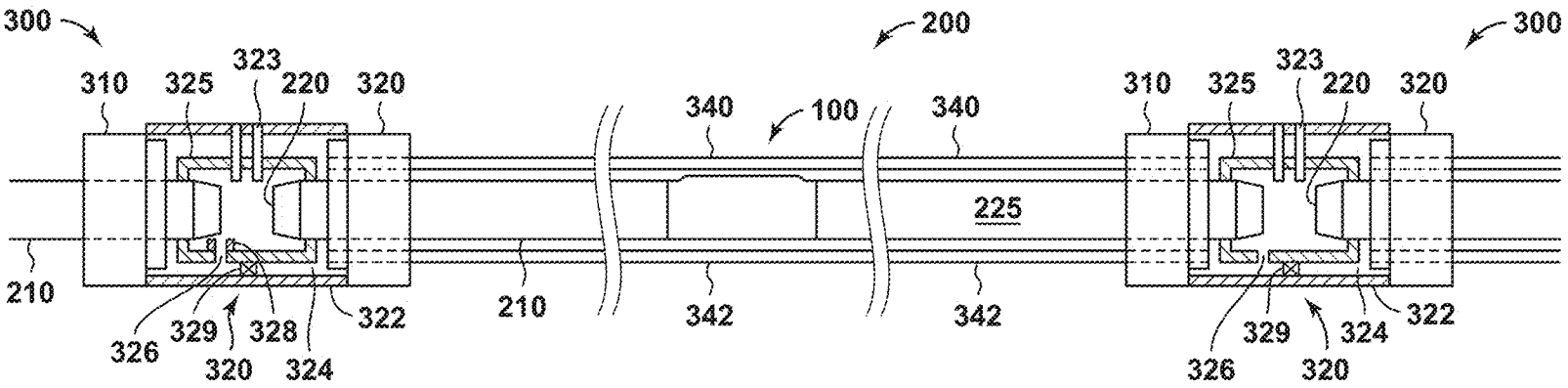
FIG. 3 is a schematic view of a sand screen assembly, in one embodiment. The sand screen assembly includes a pair of opposing coupling assemblies. A chemically-activated inflow control device is placed between joints of sand screen along the sand screen assembly.

FIG. 3 is a schematic view of a sand screen assembly 200. The sand screen assembly 200 includes one or more joints of sand screen (not separately identified) 210. As used herein, the term "sand screen" refers to any filtering mechanism configured to prevent the passage of particulate matter having a certain size, while permitting the flow of gases, liquids and certain fines. Many sand screen types are known in the art and include wire-wrap, mesh material, ceramic wrap, woven mesh, and sintered metal. The filtering medium creates a matrix that permits an ingress of formation fluids while restricting the passage of sand particles over a certain gauge.

The sand screen assembly 200 includes a pair of opposing coupling assemblies 300. Each coupling assembly 300 includes a torque sleeve 310, a coupling joint 320 and a load sleeve 330. The coupling joint 320 provides a means for threadedly connecting the torque sleeve 310 at one end and the load sleeve 330 at the opposite end. The coupling joint 320 also forms a manifold for communicating fluids between adjoining base pipes 220.

The torque sleeve 310 and the load sleeve 330 enable connections with the base pipe 220 while aligning transport conduits 340, 342 for gravel packing slurry. U.S. Pat. No. 7,661,476 discloses a production string (referred to as a joint assembly) that employs a series of sand screen joints. The '476 patent is incorporated by reference herein in its entirety.

The torque sleeve 310 and the load sleeve 330 may be connected using the coupling joint 320. The coupling joint 320 includes a main body 325 and a surrounding co-axial sleeve 322. Additionally, the coupling joint 320 includes a manifold region 324 and at least one flow port 326. Additional features of the coupling joint 320 include a torque spacer 329 and optional bolts 323. The torque spacer 329 and bolts 323 hold the main body 325 in fixed concentric relation relative to the co-axial sleeve 322.

Also, an inflow control device 328 is shown. The inflow control device 328 allows the operator to selectively open, partially open, close or partially close a valve associated with the flow port 326. This may be done, for example, by sending a tool downhole on a wireline or an electric line or on coiled tubing that has generates a wireless signal. The inflow control device 328 may be, for example, a sliding sleeve or a valve.

U.S. Pat. No. 10,012,032 is entitled "Downhole Flow Control, Joint Assembly and Method." This patent is assigned to ExxonMobil Upstream Research Company and discloses additional information about a coupling joint for connecting a torque sleeve with a load sleeve to form a coupling assembly for sand screen assemblies. This application is incorporated herein in its entirety by reference and need not be discussed further.

FIG. 3 is presented to demonstrate the placement of a chemically-activated inflow control device 100 along sand screen joints 210. As described in connection with FIGS. 1 and 2A, the sand screen joints 210 are operatively connected to opposing ends 112, 114 of the tubular body 110 of the device 100. Base pipes 220 pass through the inflow control device 100 (or alternatively are threadedly connected to a slotted base pipe within the tubular body 110) carrying production fluids.

Each sand screen assembly 300 may extend from between 40 feet and 400 feet, depending on the number of sand screen joints 210 and corresponding base pipe joints 220 that are placed in series. Multiple sand screen assemblies 300 may be placed along the horizontal leg of a wellbore corresponding to different production zones downhole. Beneficially, inflow control devices 100 allow zones that "water out" to be shut off from the primary flow path 125/215. This may be done without need of an electrical signal or a wireline tool activating a sliding sleeve.

Figure 4A:
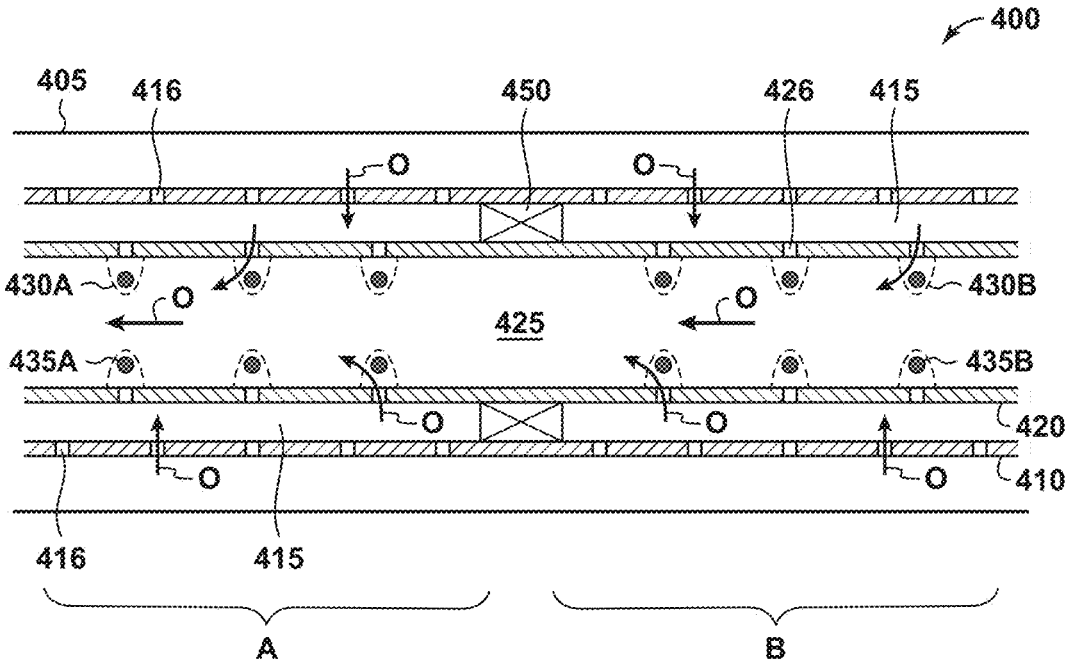
FIG. 4A is a cross-sectional view of a chemically-activated inflow control system in an alternate embodiment. The inflow control system represents a plurality of degradable ball valves residing within joints of sand screen.

Other inflow control devices that use a degradable component are also presented herein. FIG. 4A is a cross-sectional view of a chemically-activated inflow control system 400, in an alternate embodiment. The inflow control system 400 represents a plurality of degradable ball valves 430 residing within joints of sand screen 410. More specifically, the ball valves 430 reside along slots 426 of base pipes 420 within joints of sand screen 410.

In FIG. 4A, two joints of sand screen 410 are shown. The joints of sand screen 410 may be part of a sand screen assembly such as assembly 300 of FIG. 3. Each joint 410 defines an elongated tubular body made up of one or more base pipes 420 threadedly connected end-to-end. The base pipes 420 are tubular bodies, with perforations or slots 426 placed at strategic locations therein. In addition, the sand screen joints 410 include a filter medium to form sand screens. The filter medium may be a metal wire or ceramic wrap fitted around the base pipe 420. The filter medium has parallel slots sized to prevent the inflow of sand or other particles above a pre-determined size into the base pipe 420.

Each base pipe 420 preferably extends the axial length of the sand screen joint 410. In one aspect, the base pipes 420 are operably attached to a load sleeve 330 near an upstream or first end, and to a torque sleeve 310 at a downstream or second end.

Each joint of sand screen 410 may be a single joint of about 40 feet in length, or it may be a series of joints welded or otherwise connected together and extending up to 400 feet in length. The joints of sand screen 410 are separated by a packer 450. The packer 450 is not a traditional annular packer, but is a cylindrical elastomeric or thermoplastic material designed to seal off the annular flow path 415.

Each joint 410 resides in a separate producing zone. The zones are designated as "A" and "B," respectively. Zones "A" and "B" are on opposing sides of the packer 450.

Each joint of sand screen 410 contains a base pipe 420. The base pipes 420, in turn, each contain series of ball valves 430. In Zone "A" the ball valves are designated as 430A, while in Zone "B" the ball valves are designated as 430B. As the name implies, each ball valve 430A, 430B contains a spherical component, or ball. In Zone "A" the balls are designated as 435A, while in Zone "B" the balls are designated as 435B. Of interest, the balls 435A, 435B are fabricated from a material that degrades or slowly dissolves in the presence of an aqueous fluid. Such a material may again be, for example, a carbon-based or magnesium-based steel.

In FIG. 4A, each of Zones "A" and "B" is experiencing production from a surrounding formation 405. Arrows "O" indicate the production of hydrocarbon fluids (primarily oil) from Zones "A" and "B." Oil flows from the formation 405, through slots 416 in the sand screen joints 410, through slots 426 in the base pipe 410, and into a main bore 425. It is observed that the valves 430A, 430B are configured to allow fluids to flow into the main bore 425. However, as long as the balls 435A, 435B have not dissolved, treatment fluids cannot be injected back through the valves 430A, 430B and into the formation 405.

Figure 4B:
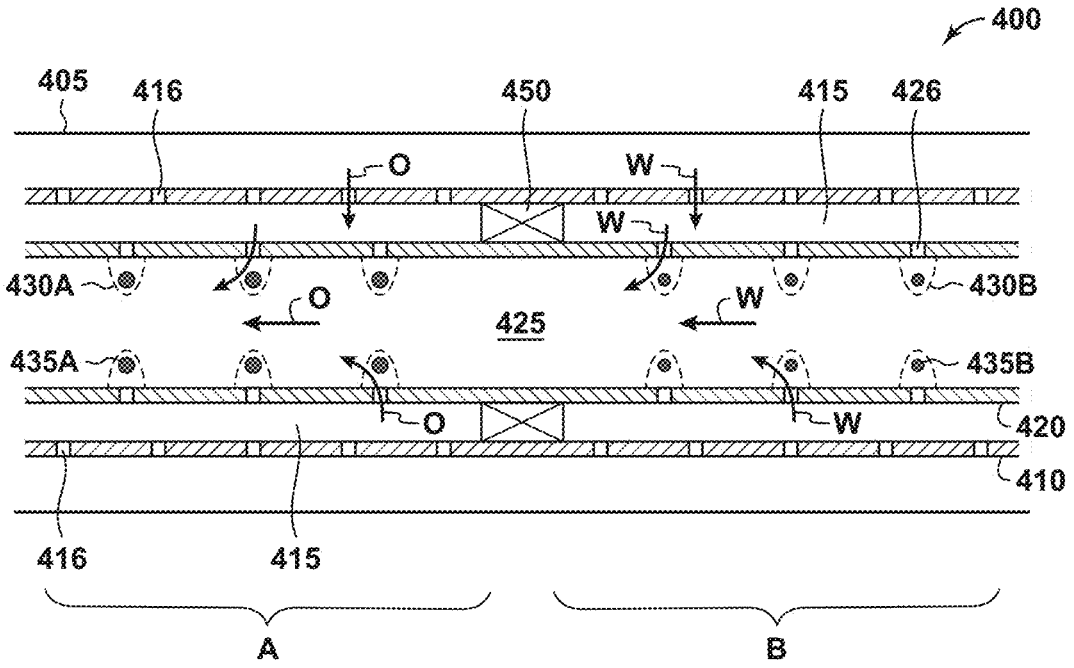
FIG. 4B is another cross-sectional view of the inflow control system of FIG. 4A. Here, ball valves exposed to water production are beginning to degrade.

FIG. 4B is another cross-sectional view of the inflow control system 400 of FIG. 4A. Here, hydrocarbon fluids "O" continue to be produced from Zone "A." However, production fluids in Zone "B" have transitioned to a predominately aqueous fluids "W." This means that balls 435B are exposed to water production. Because the balls 435B are subject to dissolving in the presence of water, the balls 435B have begun to degrade.

Figure 4C:
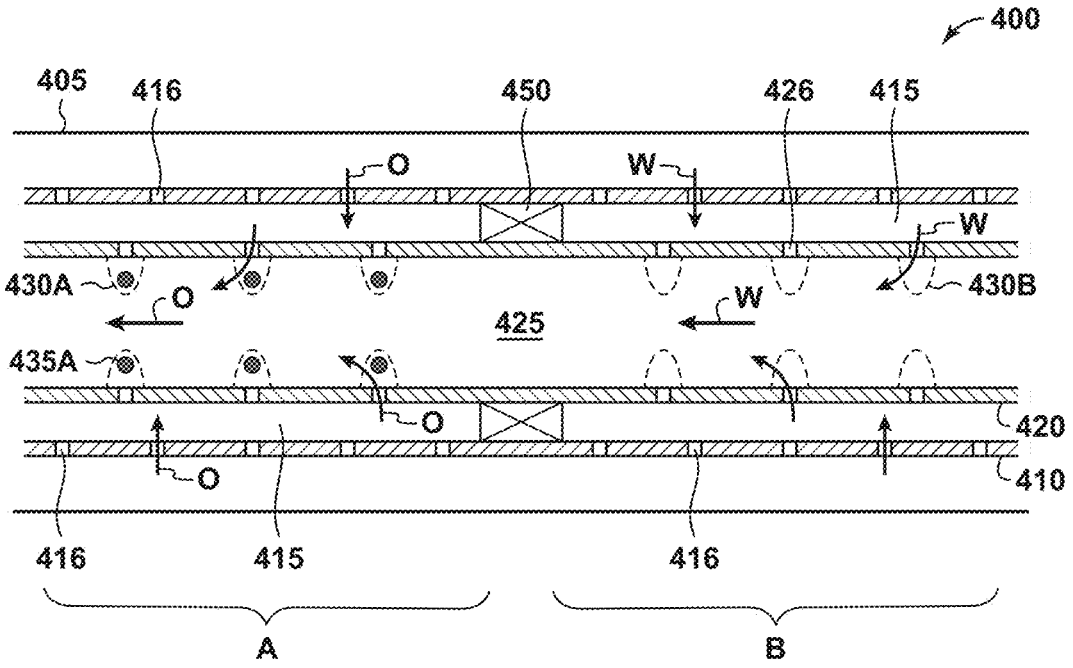
FIG. 4C is still another cross-sectional view of the inflow control system of FIG. 4A. Here, the ball valves exposed to water production have completely dissolved.

FIG. 4C is still another cross-sectional view of the inflow control system 400 of FIG. 4A. Hydrocarbon fluids continue to be produced from Zone "A," while aqueous fluids "W" continue to be produced from zone "B." It can be seen that the balls 430B exposed to water production "W" have completely dissolved.

Figure 4D:
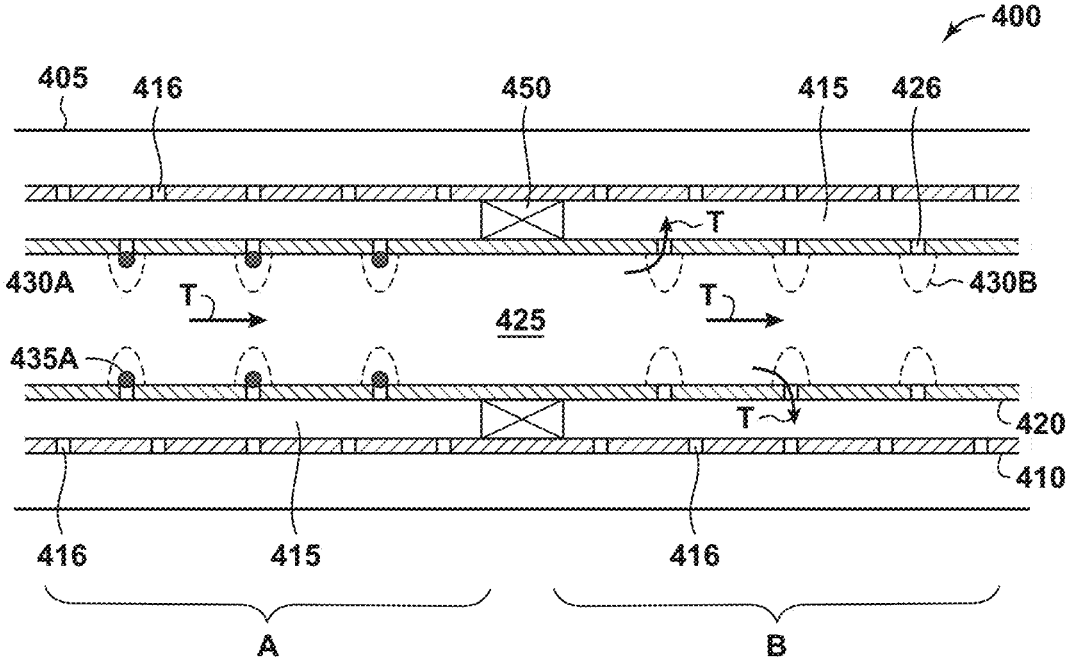
FIG. 4D is yet another cross-sectional view of the inflow control system of FIG. 4A. A treatment fluid is being passed through ports associated with the dissolved ball valves.

To remedy the production of water, the operator may desire to inject a treatment fluid "T" into the formation 405. FIG. 4D is yet another cross-sectional view of the inflow control system 400 of FIG. 4A. Arrows "T" indicate that a treatment fluid is being injected down the main bore 425 of the base pipes 420. Treatment fluid "T" is able to pass through ports 426 associated with the dissolved balls 435B and into Zone "B." However, because balls 435A remain intact, the treatment fluid "T" is not able to pass through ports 426 associated with the dissolved balls 435A and into Zone "A."

As can be seen, the inflow control system 400 is not so much an inflow control device as it is a fluid flow control system for a downhole tool. The system 400 gives the operator the ability to control the flow of treatment fluids out of a wellbore at a particular depth or along a particular zone. This may be done after an optional a gravel packing operation has been completed and well after production operations have commenced. This may be done without sending an electrical signal or running a setting tool to activate a sleeve.

Alternative forms of an automatic inflow control device are provided herein. Rather than using a degradable material such as that found in component 260 or balls 335B, an inflow control system may employ filtering material. Specifically, the material is a porous, hydrophobic material that is incorporated into subsurface equipment to form a novel inflow control device.

Figure 5B:
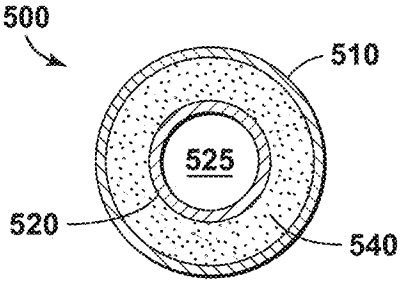
FIG. 5B is a cross-sectional view of the joint of sand screen of FIG. 5A, taken across line 5B-5B. Placement of the hydrophobic material is more clearly understood.
Figure 5A:
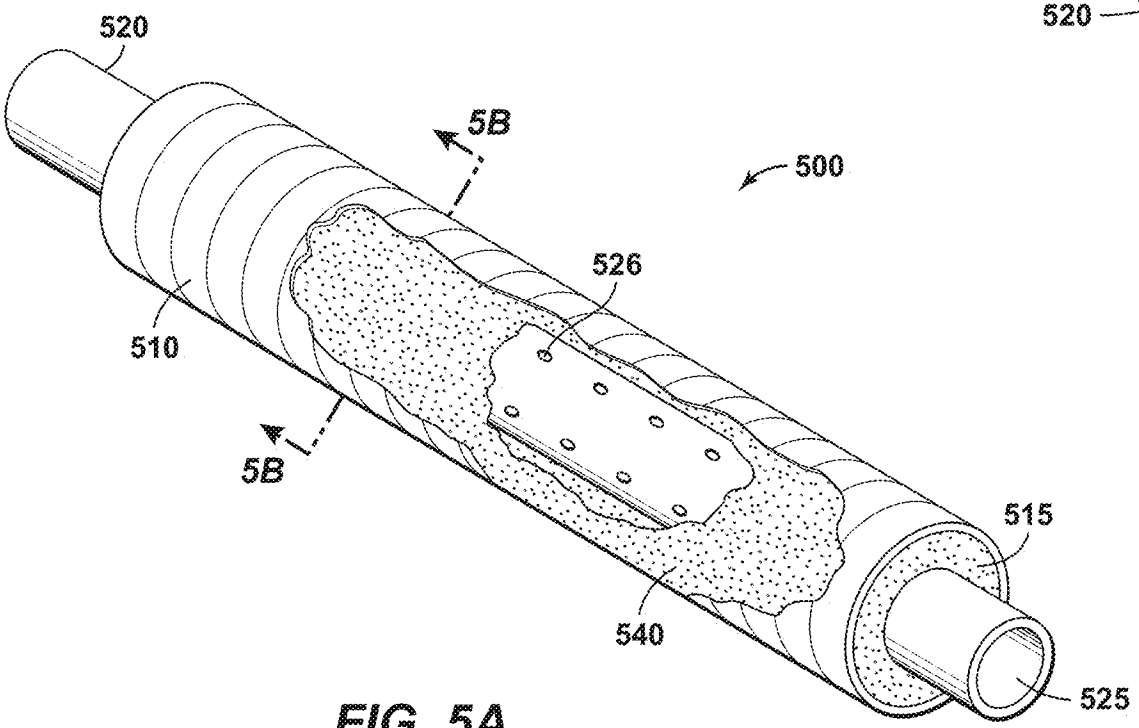
FIG. 5A is a perspective, cut-away view of a joint of sand screen of the present invention, in one embodiment. Here, the joint of sand screen comprises a hydrophobic material residing within the annular flow path.

FIG. 5A is a perspective, cut-away view of a sand screen assembly 500 of the present invention, in one embodiment. This demonstrates the use of a porous, hydrophobic material 540 that is able to restrict or "filter" water from entering the primary flow path in a wellbore.

The sand screen assembly 500 first comprises a filter medium 510. The filter medium may be metal or ceramic. The size of the filter will generally be in the range of 60-120 mesh, but may be larger or smaller depending on the specific environment. In any embodiment, the filter medium 510 creates a matrix that permits an ingress of formation fluids while restricting the passage of sand particles over a certain gauge. Preferably, the filter medium 510 is a wire-wrapped sand screen.

The sand screen assembly 500 also comprises a base pipe 520. The base pipe 520 defines an elongated tubular device that resides concentrically within the filter medium 510. A plurality of slots 526 is provided to receive hydrocarbon fluids that pass through the filter medium 510. The base pipe 520 includes an elongated bore 525 that serves as a primary flow path for hydrocarbon fluids being produced to the surface.

An annular area 515 is formed between the base pipe 520 and the surrounding sand screen 510. The annular area 515 forms a flow path for fluids that travel from a subsurface formation and through the sand screen 510 en route to the base pipe 520. The annular flow path 515 may hold one or more shunt tubes or transport tubes (not shown) used during a gravel packing operation.

The annular area 515 also contains a hydrophobic material 540. The hydrophobic material 540 is a porous material that is designed to permit hydrocarbon fluids to enter a network of pores, but resist water molecules. In this way, hydrocarbon fluids may pass through to the primary flow path 525, but production of aqueous fluids will be largely reduced.

FIG. 5B is a cross-sectional view of the sand screen assembly 500 of FIG. 5A. Here, placement of the hydrophobic material 540 within the annular flow path 515 is more clearly understood. The view is taken across line 5B-5B of FIG. 5A.

The porous hydrophobic material 540 can be a porous network of hydrophobic filaments, or it can be composed of hydrophobic particles. The hydrophobic material must be mechanically strong enough to sustain downhole pressure differential without a significant change in pore throat sizes of the connected channels between the filaments or particles.

Figure 6A:
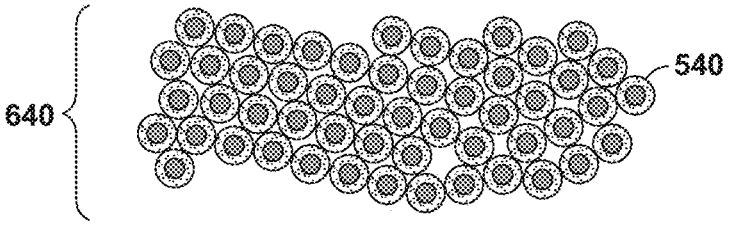
FIG. 6A is a cross-sectional view of a network of particles that may be used as the hydrophobic material of FIG. 5B.

FIG. 6A is a cross-sectional view of a three dimensional ("3D") dense pack 640 of particles that may be used as the porous hydrophobic material 540 of FIG. 6A. The 3D dense pack of spherical particles 640 has a connected network of channels between the particles with pore throat size and permeability that depends on the outer diameter of particles.

Figure 6B:
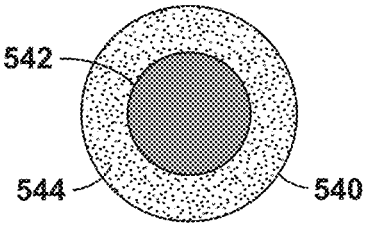
FIG. 6B is an enlarged view of one of the particles from FIG. 6A.

FIG. 6B is an enlarged view of one of the particles of material 540 from FIG. 6A. It is observed in the illustrative particle 540, a combination of two components is provided. First an inner core 542 of strong material is seen. The core 542 is preferably not absorptive of fluids. This inner core 542 may be referred to as a "kernel." The core 542 is fabricated from a carbon (or nanocarbon or other) material that is durable enough to withstand differential pressures downhole.

It is noted that the diameter of the inner core, or kernel 542 of the material 544 is dependent on the anticipated pressures within the downhole device. If anticipated pressures are low, then the kernel 542 may be very small in diameter, such as between 40 μm and 1,000 μm. Indeed, in some applications no kernel 542 may be needed at all.

Second, an outer hydrophobic layer 544 is provided around the kernel 542. The outer layer 544 represents a hydrophobic material that resists water molecules (but not organic molecules). The outer, hydrophobic layer 544 is fabricated from a material that is thermally stable in downhole conditions and that has a good tolerance to the hydrocarbon environment. The outer diameter of this hydrophobic layer is pre-selected from 50 μm to several millimeters. The particles outer diameter distribution is chosen so that the 3D dense pack 240 of spherical particles has optimal size of connected channels between particles for conducting flow of hydrocarbons while resisting water.

In one arrangement, the outer, hydrophobic layer 544 is fabricated from a network of compressible particles. Each of the compressible particles may have a compressibility of between 10% and 30%, at up to 10,000 psi. At least some of the compressible particles may comprise graphite or graphene beads. In one embodiment, each of the compressible particles comprises a porous graphite carbon (PGC) material. In this instance, an inner core 542 is composed of amorphous carbon, while an outer shell 544 is composed of graphitic carbon.

In another embodiment, each of the compressible particles comprises a polymer. For example, a co-polymer of methylmethacrylate and acrylonitrile may be used. Other polymeric materials may be used such as neoprene, polyurethane rubber, vinyl, nitrile rubber, butyl rubber, EPDM rubber, silicone rubber, or combinations thereof.

In a preferred embodiment, the material 140 utilizes PTFE or silica as the porous hydrophobic material. Specifically, the material 140 is either produced of porous silica or a porous sintered Teflon®, or it is a dense pack 240 of particles with outer layer 230 fabricated from Teflon® (PTFE) or silica or other material with hydrophobic properties. The material 140 repels water molecules while creating a porous 3D network that allows hydrocarbon molecules to flow there through. The porous hydrophobic material 140 utilizes the difference in molecular dipole moment which affects surface tension and interfacial tension resulting in changes in relative permeability and capillary pressure. While water molecules have a strong dipole moment, hydrocarbon molecules are not polarized and hence will experience significantly less resistance to flow through the porous material.

The 3D porous material 540 consists of a network 640 of connected pores. The pores form a narrow path for fluid flow. The pores are sized to create the desired water-choking effect. The hydrophobicity of the porous material 540 effectively reduces the flow path for water but allows oil to penetrate the network 640.

Referring again to FIG. 5A, the porous material 540 is packed into the annular flow path 515. The material 540 restricts the flow of water through the annular flow path 515, serving as a de facto 3D water filter that allows hydrocarbon fluids to enter the primary flow path 525 but not water. It is understood that the sand screen assembly 500 of FIG. 5A is only one example of a downhole tool that may serve as an inflow control device with the porous material 540. Other downhole tools may also be adapted for use with a porous material 540.

Figure 7B:
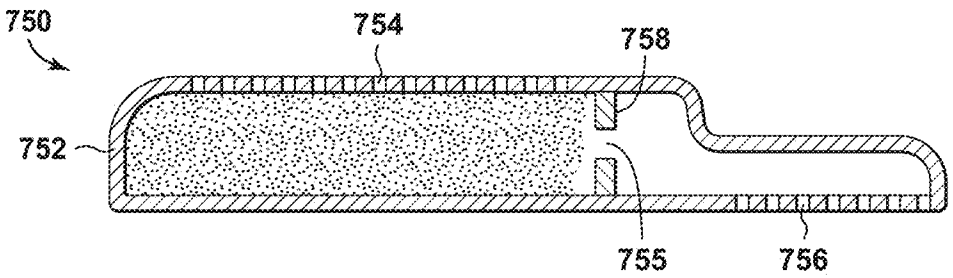
FIG. 7B is an enlarged, cross-sectional view of the ICD of FIG. 7A. Placement of hydrophobic material within the ICD is seen.
Figure 7A:
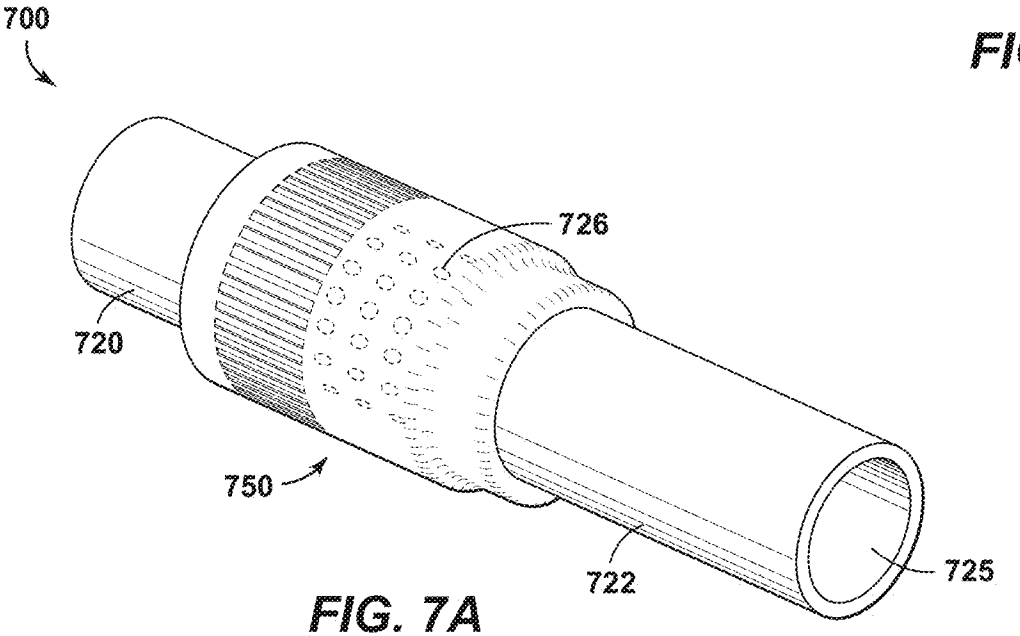
FIG. 7A demonstrates the use of an inflow control device of the present invention, in one embodiment. The inflow control device is placed on a slotted base pipe to control the flow of water into the base pipe.

FIG. 7A demonstrates the use of an autonomous inflow control device (or "ICD") 750 in an alternate embodiment.

In this arrangement, a dedicated ICD 750 is placed on a slotted base pipe 720, forming a downhole tool 700.

The downhole tool 700 first comprises base pipe 720. The base pipe 720 defines an elongated tubular body 722 forming a bore 725. The bore 725 may serve as a primary flow path for production fluids along a wellbore (not shown). The body 722 of the base pipe 720 includes a plurality of slots 726. The slots 726, shown in phantom, receive production fluids moving en route to the bore 725.

An inflow control device 750 is fitted onto the body 722 of the base pipe 720. Specifically, the ICD 750 is placed directly over the slots 726. In the arrangement of FIG. 7A, the illustrative ICD 750 is shown as a relatively slender body. However, it is understood that the ICD 750 may extend radially around the body 722 at 30°, 90°, 180° or even 360°.

FIG. 7B is an enlarged, cross-sectional view of the ICD 750 of FIG. 7A. The ICD 750 comprises a steel body 752. A restricted flow orifice 755 is created within the steel body 752. The restricted flow orifice 755 has a cross-sectional flow area sized by the operator in accordance with desired pressure and fluid flow control along the base pipe 720. The cross-sectional area is selected to create additional pressure drop in order to balance production flux.

An upper surface of the ICD 750 contains one or more through-openings 754. The through-openings 754 create fluid communication between a formation and an internal volume of the ICD 750. In the arrangement of FIG. 7B, the internal volume is filled with the porous, hydrophobic material 540.

A lower surface of the ICD 750 also contains one or more through-openings 756. Through-openings 756 are disposed along the lower surface of the ICD 750 opposite the restricted flow orifice 755. The through-openings 756 allow an egress of hydrocarbon fluids into the slots 726. Of course, in one embodiment the through-openings 756 may be a single large opening, or "cavity."

In operation, production fluids will enter a wellbore. The pressure drop inside the primary flow path 725 of the base pipe 720 will urge production fluids through the upper through-openings 754 to enter the internal volume of the ICD 750. At that point, the production fluids will encounter the hydrophobic material 540. The porous network (shown at 640 in FIG. 6A) will permit hydrocarbon fluids to pass through the restricted flow orifice 755 while restricting the flow of aqueous fluids there through. Thus, a chemical ICD is provided. Beneficially, the ICD 750 has no moving parts and acts autonomously, not requiring an electrical signal or a mechanical actuation to react on water breakthrough downhole.

Each of the downhole devices 500, 700 is designed to stop the in-flow of water into the primary flow path of a production tubular. The devices 500, 700 are merely illustrative; the porous, hydrophobic network 640 may be placed in other downhole tools. It is anticipated that an outer screen will be needed to filter sands and fines before production fluids enter the hydrophobic network 640.

In connection with use of the devices 500, 700 downhole, as the device is exposed to more water, the hydrophobic network 640 will become saturated, preventing any further flow of production fluids into the production tubular. Stated another way, water saturation creates resistance to flow over time until flow is significantly reduced or even stopped by the hydrophobic forces. Beneficially, this condition of water saturation can be reversed. This would require an increase in oil saturation within the porous network 640 combined with sufficient pressure differential. In other words, oil will need to replace the water within the porous, hydrophobic network 640. Alternatively, a reverse flushing of hot oil could be used.

Beneficially, the pore throat size of the porous hydrophobic material could be chosen such that this condition of water-induced flow resistance can be reversed with a sufficient increase in inflow oil saturation, combined with a sufficient pressure differential. In other words, the resistance to flow will decrease as oil replaces the water within the porous hydrophobic material.

Figure 8:
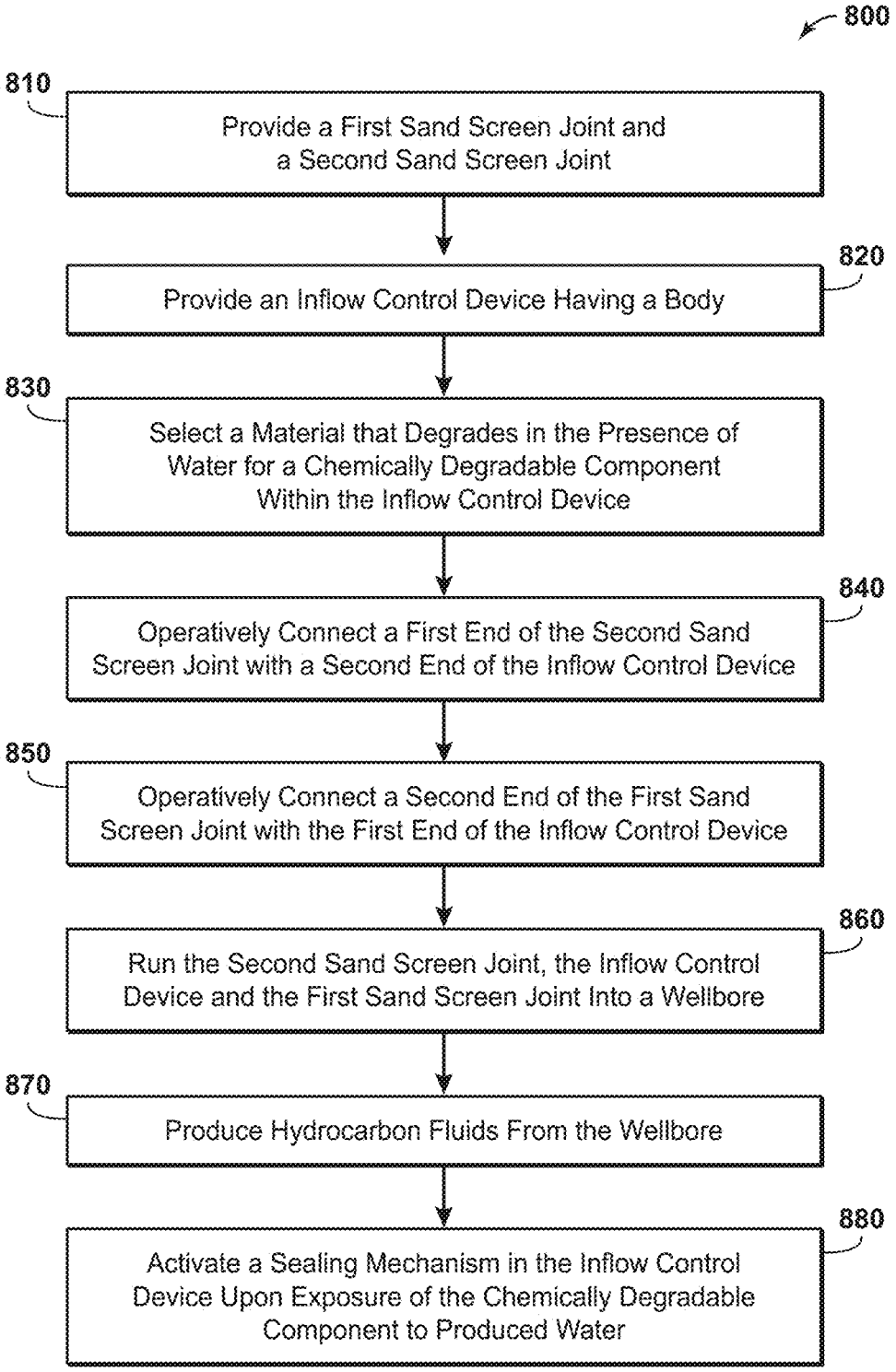
FIG. 8 is a flowchart for a method of completing a wellbore, in one embodiment. The method involves running a chemically-activated inflow control device between joints of sand screen into a wellbore.

Based on the above descriptions, a method 800 for completing a wellbore is provided herein. The method 800 is presented in FIG. 8. For the method 800, the wellbore preferably includes a lower portion completed as an open-hole. Preferably, the open hole portion is completed horizontally.

In one aspect, the method 800 first includes providing a first sand screen joint and a second sand screen joint. This is shown at Box 810. The first and second sand screen joints may be part of a sand screen assembly, such as the assembly 300 shown in FIG. 3. In this instance, coupling assemblies may be employed on opposing ends of the sand screen joints. Alternatively, they may simply be part of a series of sand screens placed within a wellbore.

In either instance, the first and second sand screen joints will first include a base pipe. The base pipe forms a primary flow path for production fluids. The first and second sand screen joints will also include a filter medium, wherein the filter media are disposed circumferentially around and reside along at least a portion of the base pipe. The filter media creates an annular flow path for production fluids moving from a surrounding subsurface formation towards an outer diameter of the base pipe during a subsurface production operation.

The method 800 additionally includes providing an inflow control device. This is seen in Box 820. The inflow control device is constructed in accordance with any of the embodiments described above. The inflow control device includes a sealing mechanism that is chemically activated. Activation occurs upon exposure to an unwanted fluid. The unwanted fluid is typically water, but it may alternatively be a light gas such as methane or ethane.

The method 800 also includes selecting a material that degrades in the presence of the unwanted fluid. This is indicated at Box 830. In one aspect, the unwanted fluid is water or other acidic fluid and the material is a carbon-based or magnesium-based steel. The chemically-degradable component retains its shape when exposed to hydrocarbon fluids at downhole temperatures and pressures. At the same time, the chemically-degradable component is fabricated from a material that degrades in the presence of water.

It is noted that the step 830 may include selecting a thickness for the material. The thinner the material, the more rapidly the material will degrade. The thickness of the material is tuned to the anticipated acidity of the fluid and the flow rate of the fluid. In one aspect, the chemically degradable substrate is between 10 mm and 1 cm in thickness.

The method 800 further includes operatively connecting a first end of the second sand screen joint with the second end of the inflow control device. This is shown in Box 840. Similarly, the method 800 includes operatively connecting a second end of the first sand screen joint with a first end of the inflow control device. This is shown in Box 850. These connections may be by welding, clamping or crimping.

The method 800 also comprises running the second sand screen joint, the inflow control device and the first sand screen joint into a wellbore. This is provided at Box 860. The method 800 then includes producing hydrocarbon fluids from the wellbore. This means that production fluids flow into the inflow control device, into the base pipe, and up to the surface. This is indicated at Box 870.

The method 800 further includes activating a sealing mechanism in the inflow control device after production operations have commenced. This is provided at Box 880. In accordance with aspects of the present invention, the sealing mechanism includes the chemically degradable component. After the chemically degradable component has been exposed to an unwanted fluid in the wellbore, the component will degrade. Upon degradation, the sealing mechanism is activated and the flow of produced fluids through the inflow control device and into the base pipe is stopped.

The rate of degradation of the component is subject to several factors. These include the nature of material making up the chemically degradable component, the thickness of the component, the acidity of the produced fluids, and the flow rate of the produced fluids into the inflow control device. In this respect, flow rate affects wall shear stress. In another embodiment, the method includes tuning the inflow control device to establish a maximum flow area into the base pipe.

Figure 9:
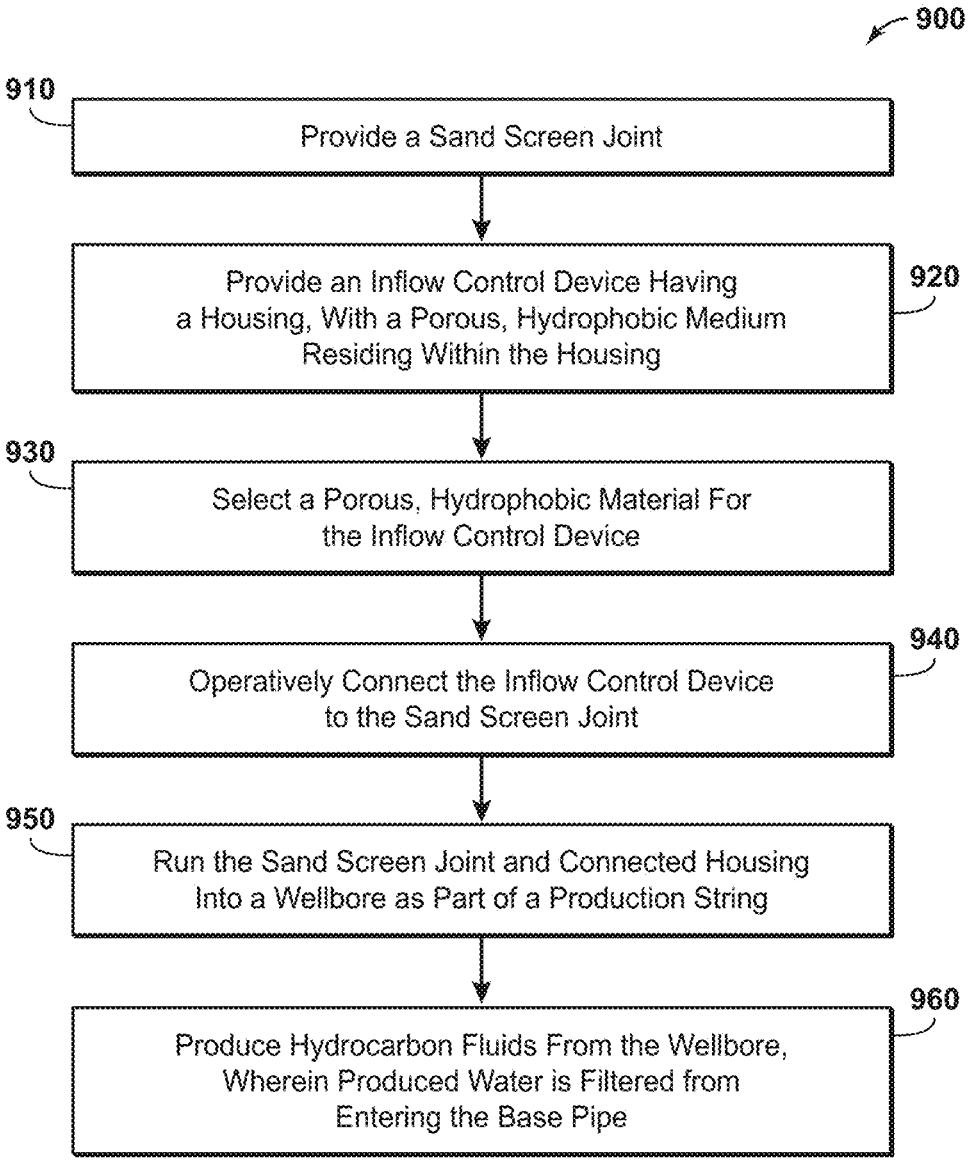
FIG. 9 is a flowchart for a method of completing a wellbore, in an alternate embodiment. The method involves running a slotted base pipe into a wellbore. A porous, hydrophobic material filters production fluids before they enter the slotted base pipe.

A second method 900 for completing a wellbore is provided herein. The second method 900 is presented in FIG. 9. In this method, the wellbore again preferably includes a lower portion completed as an open-hole. Preferably, the open hole portion is completed horizontally.

In one aspect, the method 900 first includes providing a sand screen joint. This is shown at Box 910. The sand screen joint may be part of a sand screen assembly as shown in FIG. 3. In this instance, coupling assemblies may be employed on opposing ends of the sand screen joint. Alternatively, the sand screen joint may simply be part of a series of sand screens placed within a wellbore.

The sand screen joint will include a base pipe. The sand screen joint will also include a filter medium, wherein the filter medium is disposed circumferentially around and resides along at least a portion of the base pipe. The filter medium creates an annular flow path for production fluids moving from a surrounding subsurface formation towards an outer diameter of the base pipe during a subsurface production operation.

The method 900 additionally includes providing an inflow control device. This is seen in Box 920. As shown in FIG. 5A, the inflow control device comprises a tubular base pipe having one or more through-openings for receiving production fluids within a wellbore. The device further includes a housing that holds a hydrophobic material that is positioned within the housing. Production fluids moving from a subsurface formation into slots within the base pipe must pass through the hydrophobic material.

As provided in FIG. 6A, the hydrophobic material within the inflow control device provides a network of pores. The network of pores permits a flow of hydrocarbon fluids there through en route to the through-openings, but the hydrophobic material blocks the passage of aqueous fluids there through.

The method 900 also includes selecting a material to serve as a porous, hydrophobic material for the inflow control device. This is indicated at Box 930. In one aspect, the hydrophobic material comprises a collection of individual particles, with each particle having an outer diameter of between 50 μm and 1,000 μm. In one aspect, each of the particles defines a spherical body comprising an inner core and an outer layer. The inner core is preferably a strong material such as a graphene bead.

The outer layer is fabricated from Teflon® (PTFE) or silica or other hydrophobic, porous material. The outer layer repels water molecules while creating a porous network that allows hydrocarbon molecules to flow there through.

The method 900 further includes operatively connecting the sand screen joint with the housing of the inflow control device. This is shown in Box 940. The method 900 also comprises running the sand screen joint and the inflow control device into a wellbore. This is provided at Box 950. Alternatively, the method 900 further includes placing the joint with porous hydrophobic material in the wellbore so that it faces production intervals with potential for water break-through.

The method 900 then includes producing hydrocarbon fluids from the wellbore. This is indicated at Box 960. During production, produced water is filtered from the production fluids before entering the base pipe and being carried to the surface.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. An inflow control device for a wellbore, comprising:

a tubular body having a first end, a second end, and a bore formed therebetween configured to receive a slotted base pipe; and an enlarged portion along the tubular body, with the enlarged portion housing:

a restricted flow path configured to receive production fluids when placed in the wellbore, and to direct the production fluids to one or more production fluids openings in the slotted base pipe; and a chemically-degradable component fabricated from a material that degrades over time in the presence of an unwanted production fluid and, upon degradation over a period of time, activates a sealing mechanism that closes off the restricted flow path;

wherein the chemically-degradable component comprises a chemically-degradable substrate and the sealing mechanism comprises a plunger;

wherein the plunger is biased to move to a forward position, but is maintained in a retracted position by the chemically-degradable substrate; and wherein upon degradation of the chemically-degradable substrate over the period of time, the plunger is released to move into its forward position, whereupon the plunger seals the restricted flow path of the inflow control device, preventing the flow of production fluids through the production fluids openings in the slotted base pipe.

2. The inflow control device of claim 1, wherein the unwanted fluid is water.

3. The inflow control device of claim 1, wherein:

the first end of the tubular body is operatively connected to a first sand screen joint;

the second end of the tubular body is operatively connected to a second sand screen joint; and each of the first and second sand screen joints comprises a base pipe having a bore that is in fluid communication with the bore of the slotted base pipe.

4. The inflow control device of claim 3, wherein:

an annular flow path is formed between the base pipe associated with the second sand screen joint and a filter medium around the base pipe; and the annular flow path is in fluid communication with the chemically-degradable component of the inflow control device.

5. The inflow control device of claim 4, wherein:

the enlarged portion of the tubular body defines an eccentric portion; and the chemically-degradable component resides within the eccentric portion.

6. The inflow control device of claim 5, wherein the second end of the tubular body is threadedly connected to a base pipe associated with the second sand screen joint.

7. The inflow control device of claim 5, wherein:

a first annular ring resides proximate a second end of the second sand screen joint, sealing off the annular flow path at the second end of the second sand screen joint.

8. The inflow control device of claim 5, wherein:

each of the first and second sand screen joints comprises a wire-wrapped screen or a slotted ceramic screen around a base pipe; and a second annular ring resides proximate a second end of the first sand screen joint, sealing off the annular flow path at the first end of the tubular body, thereby urging production fluids to enter the production fluids openings along the slotted base pipe.

9. A tubular production joint, comprising:

a first sand screen joint having a second end and a second sand screen joint have a first end, wherein each sand screen joint comprises a base pipe and a filter medium placed circumferentially there around, and wherein an annular flow path is formed between the base pipes and the surrounding filter media; and an inflow-control device residing intermediate the first sand screen joint and the second sand screen joint and in fluid communication with the annular flow path, the inflow control device comprising:

a tubular body having a first end, a second end and a bore formed therebetween configured to receive a slotted base pipe; and an enlarged portion along the tubular body, with the enlarged portion housing:

a restricted flow path in fluid communication with the annular flow path and configured to receive production fluids when placed in a wellbore and to direct the production fluids to one or more production fluids openings in the slotted base pipe; and a chemically-degradable component fabricated from a material that degrades over time when exposed to an unwanted production fluid within the wellbore;

wherein upon degradation of the chemically-degradable component, a sealing mechanism is activated and closes off the restricted flow path, preventing a flow of production fluids through the restricted flow path;

wherein the chemically-degradable component comprises a chemically-degradable substrate and the sealing mechanism comprises a plunger;

wherein the plunger is biased to move to a forward position, but is maintained in a retracted position by the chemically-degradable substrate; and wherein upon degradation of the chemically-degradable substrate over the period of time, the plunger is released to move into its forward position, whereupon the plunger seals the restricted flow path of the inflow control device, preventing the flow of production fluids through the production fluids openings in the slotted base pipe.

10. The tubular production joint of claim 9, wherein the unwanted fluid is water.

11. The tubular production joint of claim 9, wherein:

the first end of the tubular body is operatively connected to the first sand screen joint;

the second end of the tubular body is operatively connected to the second sand screen joint and threadedly connected to a base pipe associated with the second sand screen joint;

a slotted base pipe extends through the bore of the tubular body; and each of the first and second sand screen joints comprises a base pipe having a bore that is in fluid communication with the bore of the slotted base pipe.

12. The tubular production joint of claim 11, wherein:

an annular ring resides proximate a second end of the second sand screen joint, sealing off the annular flow path at the second end of the second sand screen joint.

13. The tubular production joint of claim 12, wherein:

each of the first and second sand screen joints comprises a wire-wrapped screen or a slotted ceramic screen around a base pipe; and a second annular ring resides proximate a second end of the first sand screen joint, sealing off the annular flow path at the first end of the tubular body.

14. The tubular production joint of claim 11, wherein the opening in the inflow control device comprises a cross-sectional fluid flow area that is pre-tuned to control a flow rate of production fluids from the annular flow path, to the production fluids openings, and into the bore of the tubular body.

15. The tubular production joint of claim 11, wherein:

the tubular body of the inflow control device comprises an eccentric portion; and the eccentric portion houses the restricted flow path, the sealing mechanism and the chemically-degradable component.

16. A method for completing a wellbore in a subsurface formation, the method comprising:

providing a first sand screen joint and a second sand screen joint, each sand screen joint comprising a first end and an opposing second end;

providing an inflow control device, the inflow control device comprising:

a tubular body having a first end, a second end and a bore formed therebetween configured to receive a slotted base pipe; and an enlarged portion along the tubular body, with the enlarged portion housing:

a restricted flow path configured to receive production fluids when placed in the wellbore, and to direct the production fluids to production fluids openings in the slotted base pipe; and a chemically-degradable component fabricated from a material that degrades over time in the presence of an unwanted fluid and, upon degradation over a period of time, activates a sealing mechanism that closes off the restricted flow path;

wherein the chemically-degradable component comprises a chemically-degradable substrate and the sealing mechanism comprises a plunger;

wherein the plunger is biased to move to a forward position, but is maintained in a retracted position by the chemically-degradable substrate; and wherein upon degradation of the chemically-degradable substrate over the period of time, the plunger is released to move into its forward position, whereupon the plunger seals the restricted flow path of the inflow control device, preventing the flow of production fluids through the production fluids openings in the slotted base pipe;

operatively connecting the first end of the tubular body with an end of the first sand screen joint;

operatively connecting the second end of the tubular body with an end of the second sand screen joint; and running the second sand screen joint, the inflow control device and the first sand screen joint into a wellbore.

17. The method of claim 16, wherein the unwanted fluid is water.

18. The method of claim 16, wherein:

running the second sand screen joint, the inflow control device and the first sand screen joint into a wellbore comprises placing the second sand screen joint, the inflow control device and the first sand screen joint into a wellbore in a horizontal leg of the wellbore; and the method further comprises:

producing hydrocarbon fluids in commercially viable quantities from the wellbore.

19. The method of claim 16, further comprising:

selecting a material that degrades in the presence of water for the chemically-degradable component.

20. The method of claim 16, further comprising:

determining a cross-sectional area for the restricted flow path of the inflow control device; and determining a thickness for the chemically-degradable substrate.

21. The method of claim 16, wherein when the plunger moves to its forward position, a distal end of the plunger lands on a shoulder provided for the restricted flow path.

22. The method of claim 21, further comprising:

sending an electrical signal to a surface when the plunger lands on the shoulder provided for the restricted flow path.

23. The method of claim 16, wherein:

the chemically-degradable component comprises a tracer element; and the method further comprises monitoring production fluids at a surface to detect the presence of the tracer element.

* * * * *